US007964816B2

(12) United States Patent
Dufournet et al.

(10) Patent No.: US 7,964,816 B2
(45) Date of Patent: Jun. 21, 2011

(54) INTERRUPTING CHAMBER HAVING TWO COMPRESSION CHAMBERS

(75) Inventors: Denis Dufournet, Sathonay-camp (FR); Michel Perret, Bourgoin Jallieu (FR)

(73) Assignee: Areva T&T SA, Paris la Defense Cedex (FR)

( * ) Notice: Subject to any disclaimer, the term of this patent is extended or adjusted under 35 U.S.C. 154(b) by 467 days.

(21) Appl. No.: 12/091,982

(22) PCT Filed: Oct. 30, 2006

(86) PCT No.: PCT/EP2006/067934

§ 371 (c)(1),
(2), (4) Date: Apr. 29, 2008

(87) PCT Pub. No.: WO2007/051778

PCT Pub. Date: May 10, 2007

(65) Prior Publication Data

US 2008/0290069 A1 Nov. 27, 2008

(30) Foreign Application Priority Data

Nov. 3, 2005 (FR) ..... 05 53325

(51) Int. Cl.
*H01H 33/72* (2006.01)

(52) U.S. Cl. ..... 218/47; 218/78; 218/154

(58) Field of Classification Search ..... 218/7, 13, 218/14, 43, 45, 46, 47, 51, 59, 67–69, 78–81, 218/84, 153, 154

See application file for complete search history.

(56) References Cited

U.S. PATENT DOCUMENTS

| | | | | |
|---|---|---|---|---|
| 3,975,602 | A | 8/1976 | Hertz et al. | |
| 4,559,425 | A | 12/1985 | Kirchesch et al. | |
| 5,977,502 | A * | 11/1999 | Mizoguchi et al. | 218/43 |
| 6,018,133 | A | 1/2000 | Thuries | |
| 6,342,685 | B1 * | 1/2002 | Perret | 218/78 |
| 7,732,727 | B2 * | 6/2010 | Saxl et al. | 218/51 |

FOREIGN PATENT DOCUMENTS

| | | |
|---|---|---|
| EP | 0591039 A1 | 4/1994 |
| EP | 0807946 | 11/1997 |
| EP | 0895262 | 2/1999 |
| EP | 0897185 A1 | 2/1999 |
| EP | 0933795 | 8/1999 |
| EP | 1548780 | 6/2005 |

OTHER PUBLICATIONS

International Search Report Dated Jan. 17, 2007.

* cited by examiner

*Primary Examiner* — Renee Luebke
*Assistant Examiner* — Marina Fishman
(74) *Attorney, Agent, or Firm* — Pearne & Gordon LLP

(57) ABSTRACT

A current-interrupting chamber is filled with a dielectric fluid and includes a moving assembly. The moving assembly is mounted to move axially between a position at the start of a circuit-breaker opening operation and a position at the end of a circuit-breaker opening operation. The moving assembly has a first compression chamber whose volume decreases between the start position and a position in which the first chamber is open; a first arcing contact designed to co-operate with a second arcing contact; and a second compression chamber communicating with the first compression chamber. The volume of the second compression chamber decreases between the start position and the end position. The second compression chamber is designed to inject fluid into the first compression chamber, between the open position and the end position, when the pressure in the first chamber is lower than the pressure in the second chamber.

26 Claims, 8 Drawing Sheets

INTERRUPTING CHAMBER HAVING TWO COMPRESSION CHAMBERS

TECHNICAL FIELD

The present invention relates to a current-interrupting chamber having two compression chambers, and to a power circuit-breaker including such a current-interrupting chamber.

STATE OF THE PRIOR ART

In the field of circuit-breakers, and in particular in the field of power circuit-breakers, it is important to use as little operating energy as possible for interrupting fault currents, e.g. short-circuit fault currents. A circuit-breaker that uses a "puffer" interrupting chamber compresses a dielectric gas, making it possible to blast an arc that strikes between arcing contacts during a current-interrupting operation or a circuit-breaker opening operation. The compression is, in general, achieved by a drive member, which can be a spring-loaded mechanism coupled to a motor, actuating a moving portion, such as a piston, inside the interrupting chamber. Such a circuit-breaker also uses the energy delivered by the arc in the form of heat, thereby reducing the consumption of external energy compared with conventional gas-compression circuit-breakers. Documents U.S. Pat. Nos. 4,559,425 and 3,975,602 describe puffer circuit-breakers. In such a circuit-breaker, the stroke of the moving portion of the interrupting chamber that achieves the compression is approximately proportional to the rated voltage of the circuit-breaker. The higher the rated voltage, in particular when said voltage is greater than about 245 kilovolts (kV), the longer the stroke, which increases the energy required for the circuit-breaker to interrupt the current.

However, in order to interrupt high currents, i.e. currents that are greater than about 60% of the breaking power assigned to the circuit-breaker, it is not necessary to compress the gas for the entire circuit-breaker opening operation because the energy delivered by the arc is sufficient to blast the arc before the circuit-breaker reaches the end of the compression stroke. Documents EP 0 897 185 and EP 0 591 039 describe puffer circuit-breakers having short compression strokes. Those circuit-breakers compress the gas for a portion of the stroke only. But when the current is low, e.g. less than or equal to about 60% of the breaking power, the energy delivered by the arc is much lower than when the current is a high current, and if, in addition, the arcing time is long (lying approximately in the range 15 milliseconds to 20 milliseconds), the external energy consumption required for blasting the arc then becomes too high.

SUMMARY OF THE INVENTION

An object of the present invention is to propose an interrupting chamber, used in particular in a power circuit-breaker, that makes it possible to interrupt both high currents and low currents, while also avoiding unnecessarily increasing the amount of external energy consumed by the drive member, regardless of the arcing time.

To this end, the present invention provides a current-interrupting chamber that can be used in a circuit-breaker, said current-interrupting chamber being filled with a dielectric fluid and including: a moving assembly mounted to move axially between a position at the start of a current-interrupting operation or of a circuit-breaker opening operation and a position at the end of a current-interrupting operation or of a circuit-breaker opening operation. The moving assembly comprises: at least one first compression chamber whose volume decreases between the position at the start of a circuit-breaker opening operation and a position at the end of compression of the first chamber; and at least one first arcing contact designed to co-operate with a second arcing contact, the two arcing contacts being mounted to move axially relative to each other. The moving assembly further comprises: at least one second compression chamber, communicating at a first end with the first compression chamber, the volume of said second compression chamber decreasing between the position at the start of driving, i.e. at the start of a circuit-breaker opening operation and the position at the end of a circuit-breaker opening operation, said second compression chamber being designed to inject dielectric fluid into the first compression chamber, between a position in which the first chamber is open and the position at the end of the circuit-breaker opening operation, when the pressure in the first compression chamber is lower than the pressure in the second compression chamber.

The position at the end of compression of the first chamber is reached before the position at, the end of the circuit-breaker opening operation, and a position at the end of compression of the second chamber is reached after the position at the end of compression of the first chamber.

In the invention, compared with known devices, at least one second compression chamber is added. Thus, co-operation between the two compression chambers makes it possible, when interrupting a high current, to keep the advantage of a short compression stroke traveled by the first compression chamber, and, when interrupting a low current, to keep the advantage of achieving the interruption without unnecessarily increasing the consumption of external energy, be it mechanical or hydraulic, regardless of the arcing time, and in particular when the arcing time is long.

When the current is low and when the arcing time is long, the second compression chamber makes it possible to maintain the blasting of the arc, performed in a first stage by the first compression chamber, throughout the entire arcing time, while avoiding consuming too much external energy by using the energy delivered by the arc throughout the entire blasting time.

The current interrupting chamber comprises a thermal expansion volume used for the blasting of the arc and two compression volumes. The first compression chamber is quickly overpressure by using the moving of arcing contacts during only a first part of the entire stroke of the moving assembly. The compression in the first chamber is thus performed during a short compression stroke, allowing a fast pressure increase and blasting performances better than those of devices in which the compression is performed during the entire stroke. The second compression chamber intervenes if necessary to contribute to the blasting at the end of the stroke of arcing contacts.

The fact that the compression is first performed in the first chamber and then in the second chamber allows reducing the necessary energy for the moving of the interrupting-chamber.

Thus, the use of an interrupting chamber of the invention in a circuit-breaker makes it possible, for example, for drive members to be used that have a spring-loaded mechanism requiring little energy.

The second compression chamber may communicate with the first compression chamber via at least one valve, e.g. a check valve.

The current-interrupting chamber may include at least one first tubular element forming the first compression chamber.

The first compression chamber may, at a first end, have a nozzle co-operating with the second arcing contact to channel the gas coming from said first compression chamber. In addition, at the beginning of the circuit-breaker opening operation, the nozzle and the second arcing contact can co-operate to close the first compression chamber at its first end.

The current-interrupting chamber may include at least one piston closing the first compression chamber at a second end.

The current-interrupting chamber may also include means for holding the piston stationary between the position at the start of the circuit-breaker opening operation and the position at the end of compression of the first chamber. Thus, by remaining stationary between the two positions, the piston reduces the volume of the first compression chamber and thus compresses the dielectric fluid present in the first compression chamber.

In which case, the means for holding the piston stationary may comprise at least one recess designed to receive an abutment, e.g. a ball, coupled to the piston.

The current-interrupting chamber may also include means for moving the piston axially with the moving assembly between the position at the end of compression of the first chamber and the position at the end of the circuit-breaker opening operation.

The current-interrupting chamber may include means for releasing the abutment from the locking recess between the position at the end of compression of the first chamber and the position at the end of the circuit-breaker opening operation.

In which case, the means making it possible to release the abutment comprise at least one recess serving to receive said abutment.

The current-interrupting chamber may include at least two coaxial second tubular elements forming the second compression chamber.

The current-interrupting chamber may include means for closing the second compression chamber at a second end.

The means for closing the second compression chamber may be stationary means, such as at least one sleeve, or at least one filling valve and at least one discharge valve, or moving means, such as at least one piston that may co-operate with at least one spring.

The current-interrupting chamber can include at least one partition subdividing the first compression chamber into at least two volumes, the partition being provided with at least one valve, e.g. a check valve, making it possible to put the two volumes into communication with each other. This provision makes it possible to reduce the diameter of the active portion of the circuit-breaker, which is advantageous for air-insulated switchgear (switchgear with an insulator) or metal-clad switchgear.

The dielectric fluid may be a dielectric gas, e.g. sulfur hexafluoride ($SF_6$), nitrogen ($N_2$), dry air, carbon dioxide ($CO_2$), or a mixture of gases.

The current-interrupting chamber may include means for moving the second arcing contact in a direction opposite from the direction in which the moving assembly moves during the circuit-breaker opening operation. In which case, the current-interrupting chamber is chamber having dual contact movement.

BRIEF DESCRIPTION OF THE DRAWINGS

The present invention will be better understood on reading the following description of embodiments given merely by way of indicative and in no way limiting example, with reference to the accompanying drawings, in which.

Identical, similar, or equivalent portions of the various figures described below bear like numerical references so as to facilitate going from one figure to another.

DETAILED DESCRIPTION OF PARTICULAR EMBODIMENTS

Figure 1A:
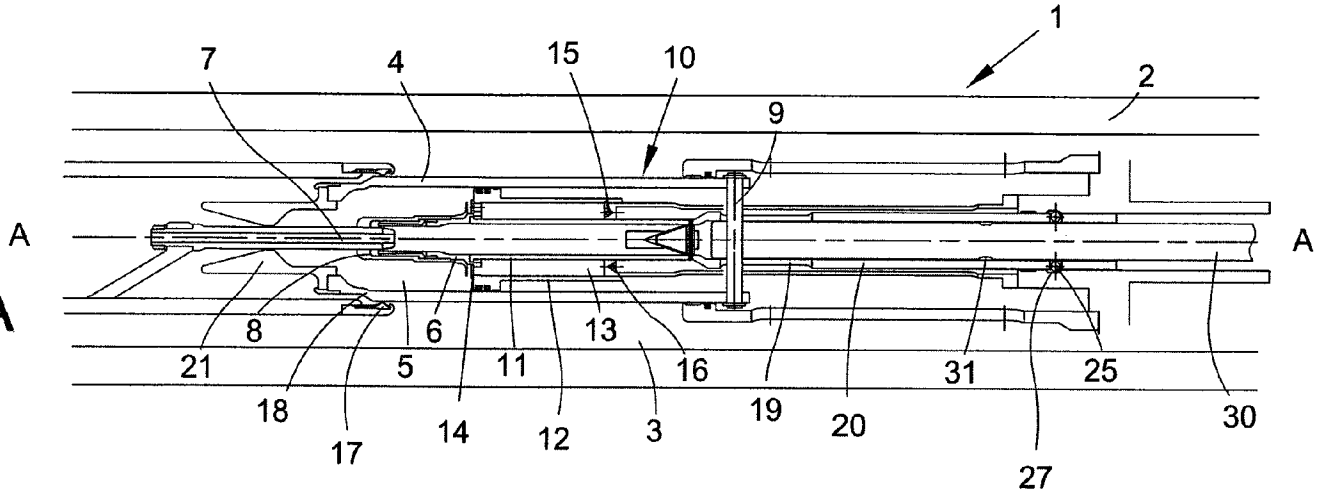
FIGS. 1A to 1C show a current-interrupting chamber of a first embodiment of the present invention, at various stages of a circuit-breaker opening operation.

FIG. 1A shows an interrupting chamber 1 of a first embodiment of the present invention. In FIG. 1A, the interrupting chamber 1 is in the engaged position, i.e. in the position in which the interrupting chamber 1 finds itself at the beginning of a current-interrupting operation, i.e. at the beginning of a circuit-breaker opening operation.

The interrupting chamber 1 has a casing 2 filled with a dielectric fluid 3 (a dielectric gas in this example) under pressure. The gas 3 can, for example, be sulfur hexafluoride ($SF_6$), nitrogen ($N_2$), dry air, carbon dioxide ($CO_2$) or indeed a mixture of gases. The dielectric fluid could also be a plasma. The interrupting chamber 1 has a first tubular element 4 forming a first compression chamber 5. The first compression chamber 5 is closed at a first end by a piston 6, and it has a nozzle 21 at a second end. The interrupting chamber 1 also has first and second arcing contacts 8, 7 mounted to move relative to each other along an axis AA. In FIG. 1A, the second arcing contact 7 is co-operating with the nozzle 21 to close the first compression chamber 5 at its second end. In the first three embodiments that are described, the first arcing contact 8 is a moving arcing contact, and the second arcing contact 7 is a stationary arcing contact. The first arcing contact 8, which, in this example, is integrated into the piston 6, is disposed inside the first compression chamber 5.

The interrupting chamber 1 has at least two second tubular elements 11, 12 that are coaxial with the axis AA. In the first embodiment, the two second tubular elements 11, 12 are part of the piston 6. The space between the two second tubular elements 11, 12 forms a second compression chamber 13. Typically, the volume of the second compression chamber 13 is about three times smaller than the volume of the first compression chamber 5. In FIG. 1A, the second compression chamber 13 is in communication with the first compression chamber 5, at a first end, via at least one valve 14, which, in this example, is a check valve. The valve 14 opens only when the pressure in the second compression chamber 13 is greater than the pressure in the first compression chamber 5. In this first embodiment, the second compression chamber 13 is closed at a second end by at least one filling valve 15 and at least one discharge valve 16. The discharge valve 16 operates as a pressure regulation valve: if the pressure in the second compression chamber 13 exceeds a certain threshold but remains less than the pressure prevailing in the first compression chamber 5, the valve 14 then remaining closed, the discharge valve 16 removes the excess pressure from the second compression chamber 13. The discharge valve 16 is thus used when the current to be interrupted is high and/or the arcing time is long, i.e. when the blasting performed by the first compression chamber 5 is sufficient to extinguish the arc. The filling valve 15 is used after the circuit-breaker opening operation, so that the gas 3 can enter the second compression chamber 13 when the interrupting chamber 1 returns to the engaged position.

The interrupting chamber 1 also has permanent contacts 17, 18 that pass current when the interrupting chamber 1 is in the engaged position. Like the arcing contacts 7, 8, the permanent contacts 17, 18 are mounted to move axially relative to each other along the axis AA. In all three of the embodiments described, only the contact 18 that is part of the first tubular element 4 is a moving contact.

The interrupting chamber 1 also has a tube 30. A first end of the tube 30 is coupled to the first tubular element 4 via a rod 9 disposed perpendicularly to the tube 30. In the first embodiment, the rod 9 crosses through a third tubular element 20, which is connected to the piston 6 and inside which the tube 30 is disposed. The arcing contact 8, the first compression chamber 5, the second compression chamber 13, the piston 6, the tube 30, the rod 9, and the third tubular element 20 form a moving assembly 10 adapted to be moved along the axis AA inside the casing 2 during the circuit-breaker opening operation, or during the current-interrupting operation.

Figure 1B:
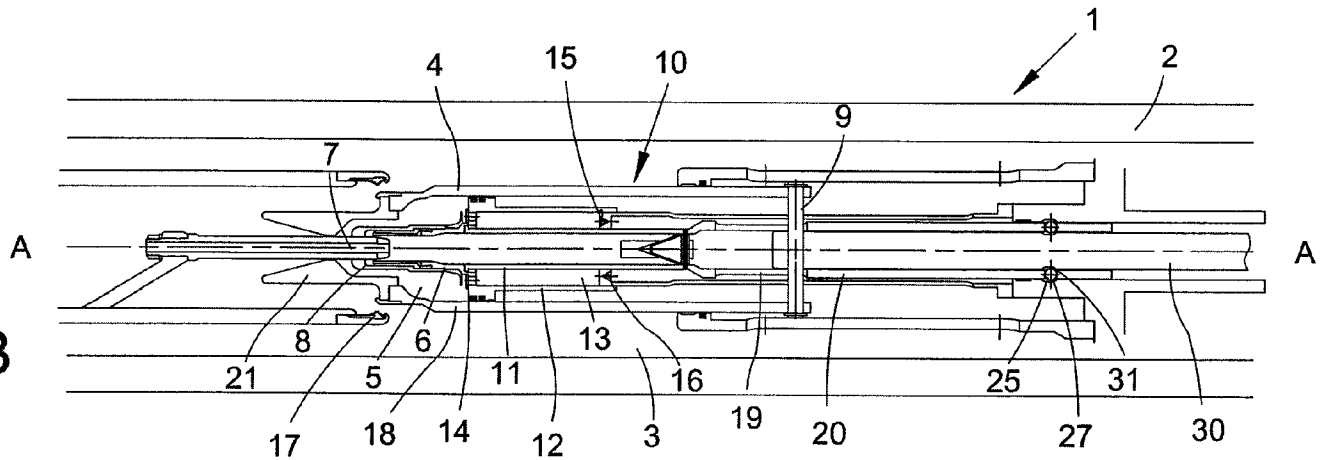

FIG. 1B shows the first embodiment of the interrupting chamber 1 in its position at the end of compression of the first compression chamber 5. In this position, relative to the engaged position, all of the elements of the moving assembly 10 except for the piston 6 and the third tubular element 20 have been moved along the axis AA by drive means (not shown) coupled to a second end of the tube 30. The stroke from the position at the start of the circuit-breaker opening operation to the position at the end of compression of the first compression chamber 5 is referred to as the "first portion" of the circuit-breaker opening operation or of the current-interrupting operation. During said first portion of the circuit-breaker opening operation, the first tubular element 4 moving reduces the volume of the first compression chamber 5 because the piston 6 remains stationary, thereby increasing the pressure inside the first compression chamber 5. First means hold the piston 6 stationary for this first portion of the circuit-breaker opening operation. In the first embodiment, said first means are constituted by at least one stationary recess 27 serving to receive at least one abutment 25 coupled to the piston 6 via the third tubular element 20. In the first embodiment, the abutment 25 is a ball inserted into a wall of the third tubular element 20. During said first portion of the circuit-breaker opening operation, the rod 9, driven by the tube 30, moves along a groove 19 formed in the third tubular element 20, thereby leaving the third tubular element 20 and the piston 6 stationary. In general, the axial stroke traveled during this first portion of the circuit-breaker opening operation represents approximately in the range one third of the total axial stroke during a circuit-breaker opening operation to one half of said total axial stroke. In FIG. 1B, the permanent contacts 17, 18 are no longer in contact with each other unlike the arcing contacts 7, 8 which are still in contact with each other. Thus, in the position at end of compression of the first compression chamber 5, current flows via the arcing contacts 7, 8 only. The arcing contacts 7, 8 are in contact with each other during all the first chamber 5 compression period. In the position at the end of compression of the first compression chamber 5, as shown in FIG. 1B, second means make it possible to release the piston 6 so that it can move. In the first embodiment, said second means comprise at least one recess 31 provided in the tube 30, making it possible for the ball 25 to exit from the recess 27, thereby no longer preventing the third tubular element 20 and the piston 6 from moving.

Figure 1C:
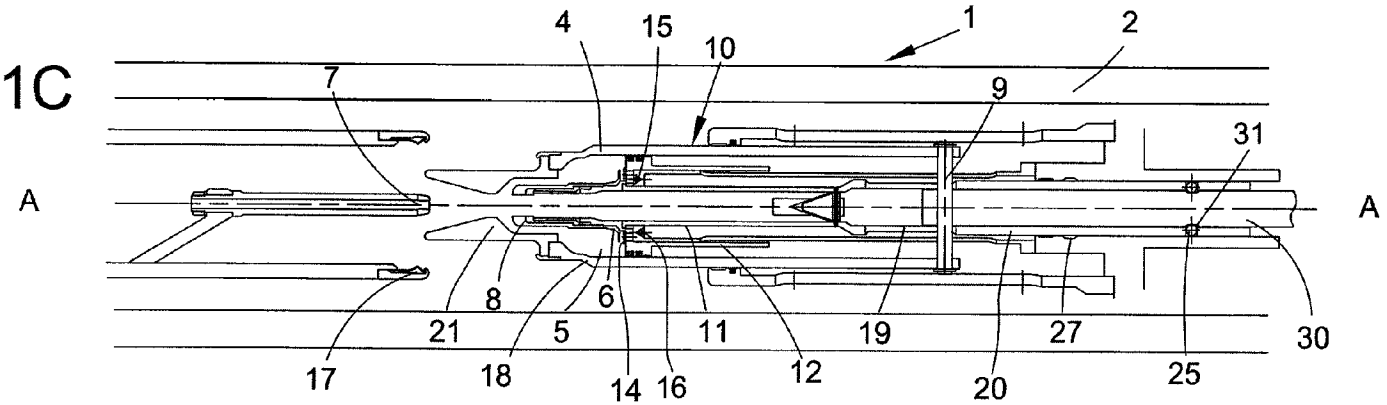

FIG. 1C shows the first embodiment of the interrupting chamber 1 in the position at the end of circuit-breaker opening, corresponding to a position at the end of compression of the second compression chamber 13. In this position, relative to the position shown in FIG. 1B, all of the elements of the moving assembly 10 have been moved along the axis AA. The stroke from the position at the end of compression of the first compression chamber to the position at the end of compression of the second compression chamber 13 is referred to as the "second portion" of the current-interrupting operation or of the circuit-breaker opening operation. During said second portion of the circuit-breaker opening operation, the rod 9 moving causes the piston 6 to move axially via the third tubular element 20. The piston 6 moving reduces the volume of the second compression chamber 13, thereby increasing the pressure inside the second chamber 13. Since the compression in the first compression chamber is finished and since the compression of the gas takes place in the second chamber only, the amount of energy required to move the moving assembly 10 is much smaller during said second portion of the circuit-breaker opening operation than during the compression of the first chamber 5. In the first embodiment, the filling valve 15 and the discharge valve 16 are stationary.

During said second portion of the circuit-breaker opening operation, an arc strikes between the two arcing contacts 7, 8 when they are no longer in contact with each other. The arcing contacts 7, 8 are separated with each other after the end of compression of the first chamber 5. Then the interrupting chamber 1 goes through a position in which the first compression chamber 5 is open. This position is reached when the nozzle 21 ceases to co-operate with the arcing contact 7 to close the first compression chamber 5. The arc striking between the arcing contacts 7 and 8 then goes via the nozzle 21. The arc is blasted when the arcing contact 7 ceases to co-operate with the nozzle 21 to close the first compression chamber. When the first compression chamber 5 opens at the nozzle 21, the excess pressure generated in the first compression chamber 5 causes the volume of gas contained in the first chamber 5 to be blasted towards the casing 2 through the nozzle 21. The blasting is achieved by a volume of gas having a high density because the compression of the first chamber 5 is ended before the separation of the arcing contacts 7, 8, thus improving interrupting performances compared to a compression of the first chamber which would be partially performed at the time of the separation of the arcing contacts 7, 8.

If the arcing time is short, the blasting achieved by the first compression chamber 5 is sufficient to extinguish the arc.

If the arcing time is long, and if the magnitude of the current is close to the fault current magnitude, the energy provided by the arc is sufficient for the blasting generated by the first compression chamber 5 to extinguish the arc.

In both of these cases, the discharge valve 16 makes it possible to remove any excess pressure generated in the second compression 13 during the circuit-breaker opening operation.

However, if the arcing time is long, and the magnitude of the current is low, i.e. less than about 60% of the fault current magnitude, the energy provided by the arc is insufficient for the blasting generated by the first compression chamber 5 to extinguish the arc. The arc is thus still present after decompression of the gas present in the first chamber 5. The pressure in the first compression chamber 5 is then lower than the pressure in the second compression chamber 13, thereby causing the valve 14 to open. Gas is then blasted from the second compression chamber 13, and said blasting continues until the moving assembly 10 reaches the end of its stroke or until the arc is extinguished.

Figure 2A:
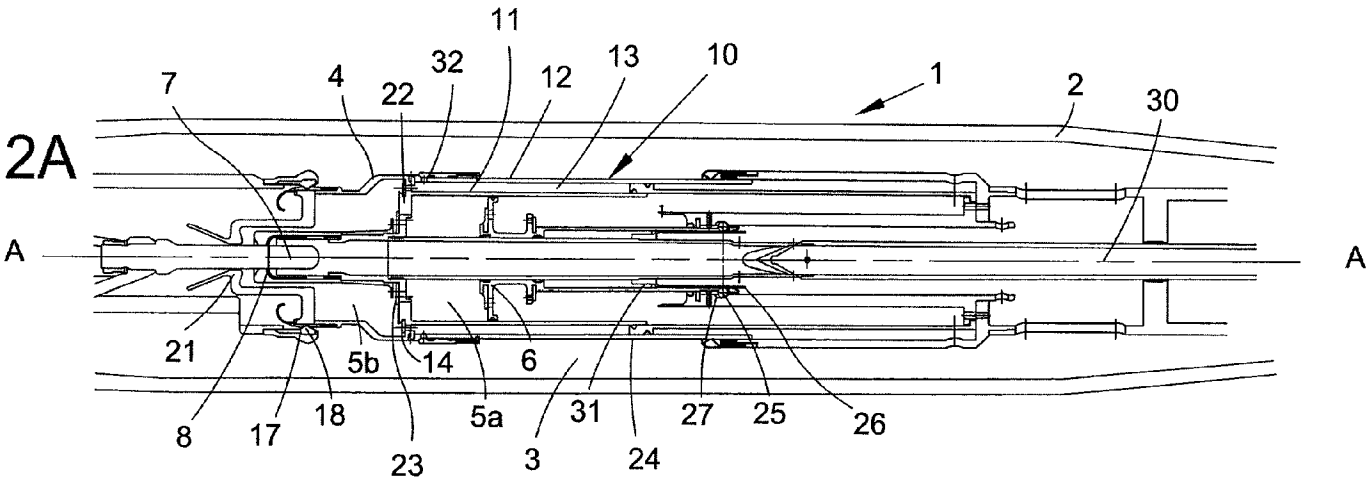
FIGS. 2A to 2C show an interrupting chamber of a second embodiment of the present invention, at various stages of a circuit-breaker opening operation.

FIG. 2A shows a second embodiment of a current-interrupting chamber 1 of the invention. In FIG. 2A, the interrupting chamber 1 is in the position at the start of a circuit-breaker opening operation, or of a current-interrupting operation.

Unlike in the first embodiment, the first compression chamber 5 has two volumes 5*a*, 5*b* in this example. The first volume 5*a* is the volume in which compression takes place by means of the piston 6 during the first portion of the circuit-breaker opening operation. The two volumes 5*a*, 5*b* are separated by a wall 22 provided with at least one check valve 23 that opens only when the pressure in the first volume 5*a* is greater than the pressure in the volume 5*b*. Thus, when the gas is compressed in the first volume 5*a*, the pressure increases similarly in the second volume 5*b*. In this example, the first compression chamber 5 is formed by the first tubular element 4, which forms the second volume 5*b*, and by the second tubular element 11, which forms the first volume 5*a*. The two second tubular elements 11 and 12, which are coaxial relative to the axis AA, form the second compression chamber 13. In said second embodiment, the second compression chamber 13 is closed at the second end by stationary means, e.g. by means of a sleeve 24. The interrupting chamber 1 also has the two arcing contacts 7 and 8 as in the first embodiment. Only the arcing contact 8, which, in this example, is integrated into the first tubular element 4, is a moving arcing contact. In the second embodiment, since the second compression chamber 13 is closed by a sleeve 24 and not by a filling valve, the second compression chamber 13 is provided with a pressure-limiting valve 32 serving to perform the same function as the filling valve 16 that is used in the first embodiment. In the second embodiment, the piston 6 is mounted to slide on the tube 30, without using an intermediate tubular element 20 as in the first embodiment, and the ball 25 is inserted directly into the wall of the piston 6.

Figure 2B:
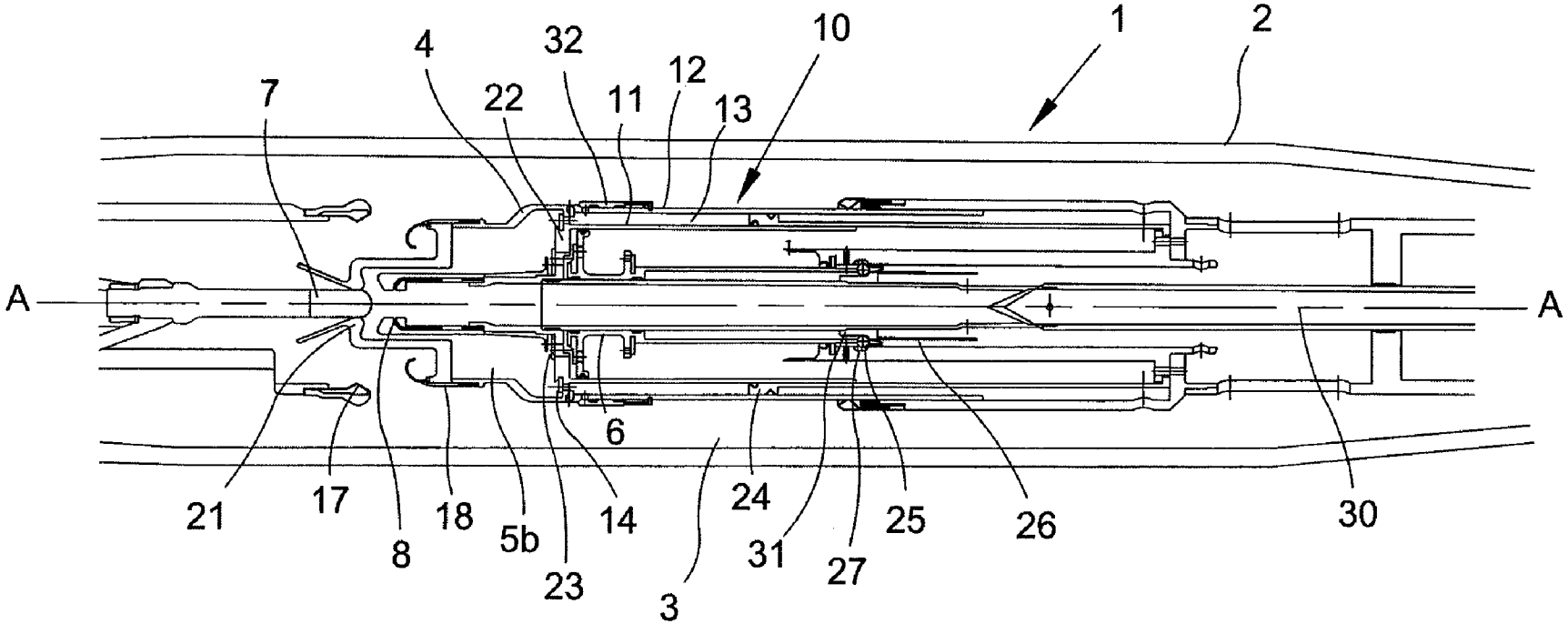
Figure 2C:
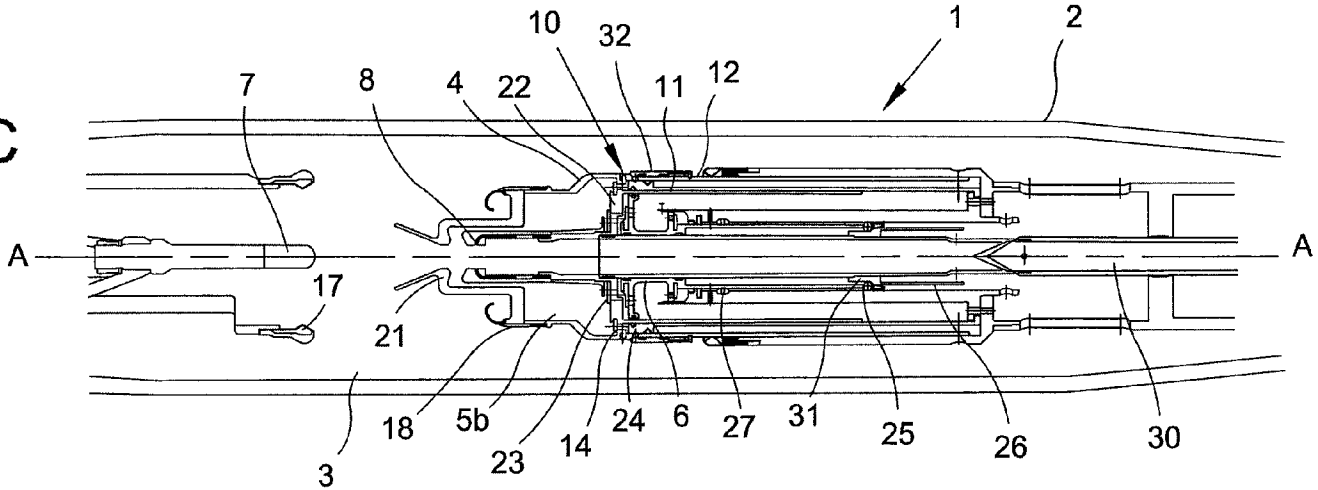

FIG. 2B shows the second embodiment of the interrupting chamber 1 in the position at the end of compression of the first compression chamber 5. As in the first embodiment, relative to the engaged position, all of the elements of the moving assembly 10 except for the piston 6 have been moved along the axis AA by drive means (not shown). In the position at the end of compression of the first compression chamber, the wall 22 finds itself in contact with the piston 6, the first volume 5*a* having become zero or almost zero. The pressure thus generated by the first volume 5*a* thus finds itself in the second volume 5*b*. Unlike in the first embodiment, the compression in the second compression chamber 13 takes place throughout the circuit-breaker opening operation. As can be seen in FIG. 2A, during the first portion of the circuit-breaker opening operation, the ball 25 rolls on a rod 26 mounted on the tube 30. When the moving assembly 10 that is moving axially reaches the position at the end of compression of the first compression chamber 5, a recess 31 provided in the rod 26 makes it possible for the ball 25 to exit from its recess 27, thereby making it possible for the piston 6 to move. Thus, during the second portion of the circuit-breaker opening operation, the piston 6 is driven with the moving assembly 10 by the wall 22 and by the balls being released, until it reaches the position at the end of compression of the second compression chamber 13, shown in FIG. 2C. Since the principle of operation of the compression chamber is identical for both embodiments, FIG. 2C is not described in detail.

Figure 3A:
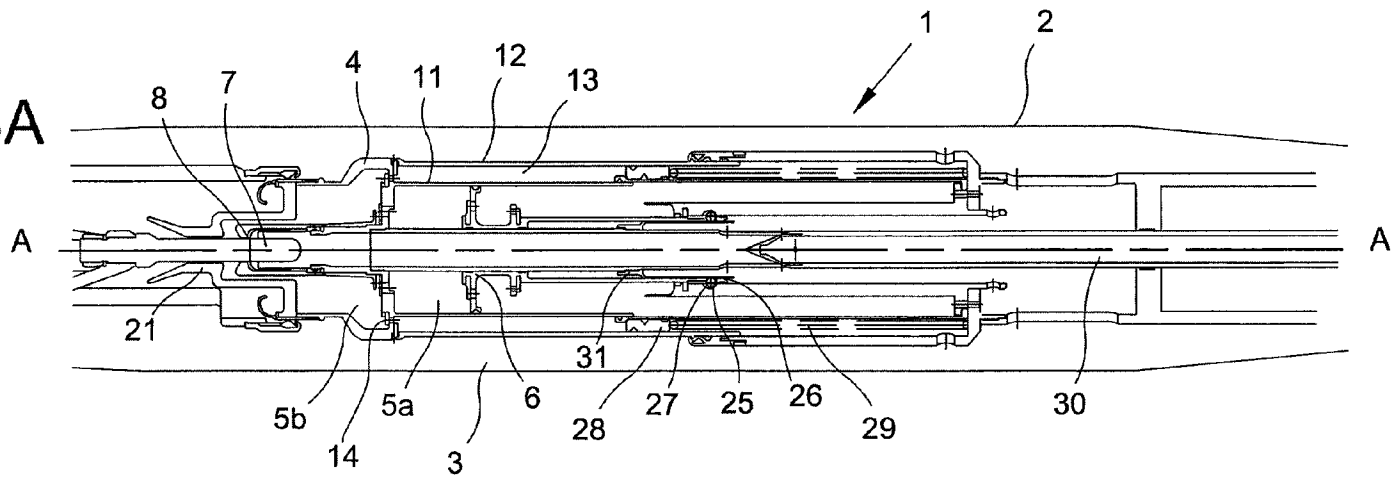
FIGS. 3A to 3D show a third embodiment of a current-interrupting chamber of the present invention, at various stages of a circuit-breaker opening operation.
Figure 3B:
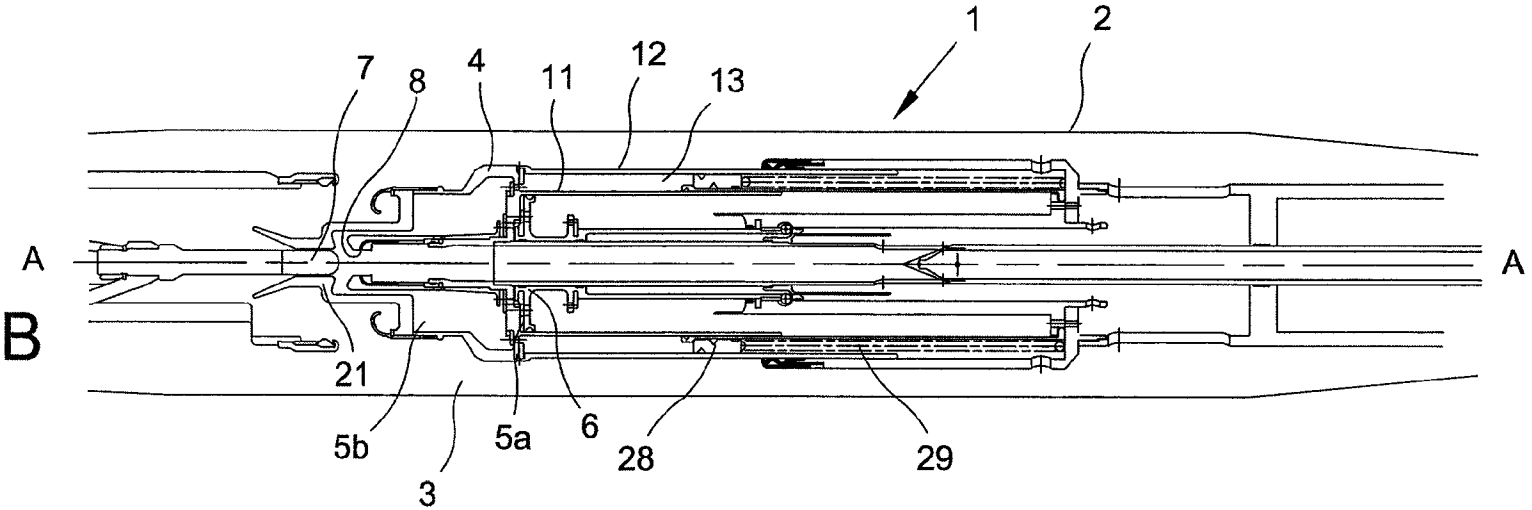
Figure 3C:
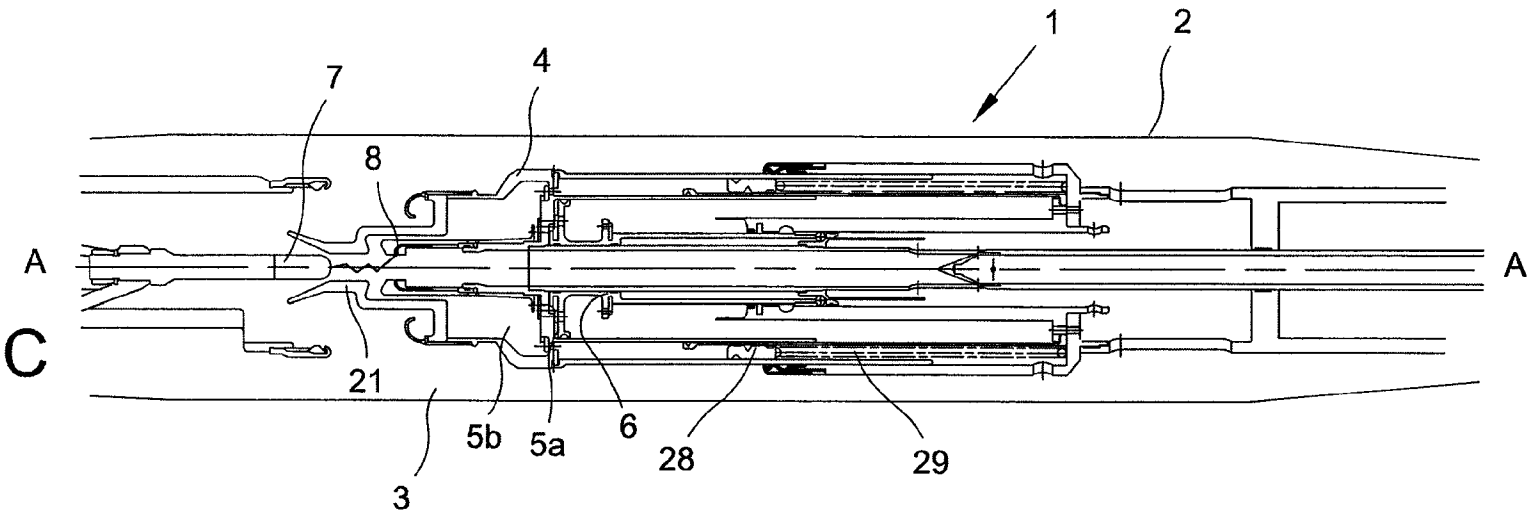
Figure 3D:
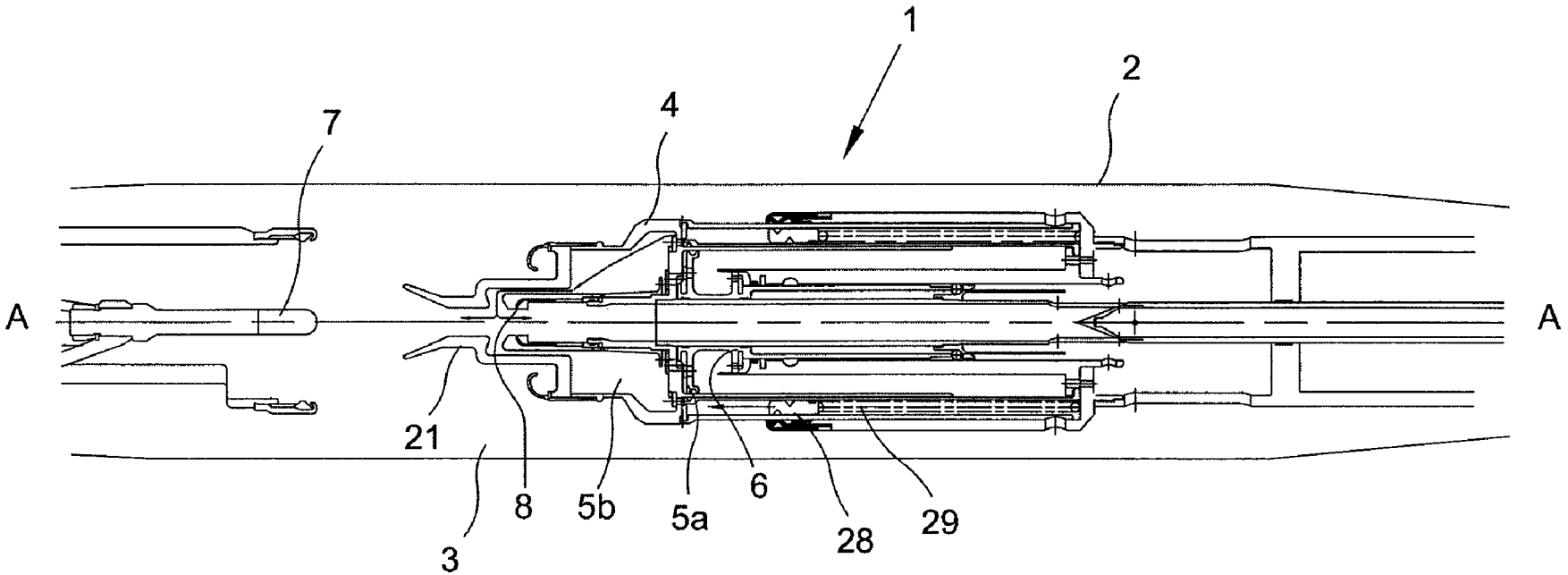

FIG. 3A shows a third embodiment of an interrupting chamber 1 of the invention. Compared with the second embodiment, the second compression chamber 13 is closed at its second end by moving means, e.g. by means of a piston 28 and of a spring 29. Said moving means make it possible to regulate the pressure in the second compression chamber 13 throughout the entire circuit-breaker opening operation. Thus, when the moving assembly 10 reaches the position at the end of compression of the first compression chamber 5, shown in FIG. 3B, the piston 28 is in a position substantially similar to the position of FIG. 3A, the pressures in the first and in the second compression chamber 5, 13 being substantially identical. During the second portion of the circuit-breaker opening operation, shown by FIG. 3C, if the pressure becomes too high, e.g. when the gas 3 is removed via the discharge valve 16 or the pressure-limiting valve 32 in the first two embodiments, in this example the piston 28 moves backwards so as to prevent the pressure from increasing too much in the second compression chamber 13. The arc formed between the arcing contacts 7, 8 is firstly blasted by the gas exiting from the first compression chamber 5 via the nozzle 21, and then, when the pressure decreases in the first compression chamber 5, the piston moves forwards so as to continue blasting the arc throughout the entire stroke of the moving assembly 10, as shown in FIG. 3D. The third embodiment makes it possible to distribute as well as possible the blasting performed by the second compression chamber 13, throughout the entire arcing time.

Figure 4A:
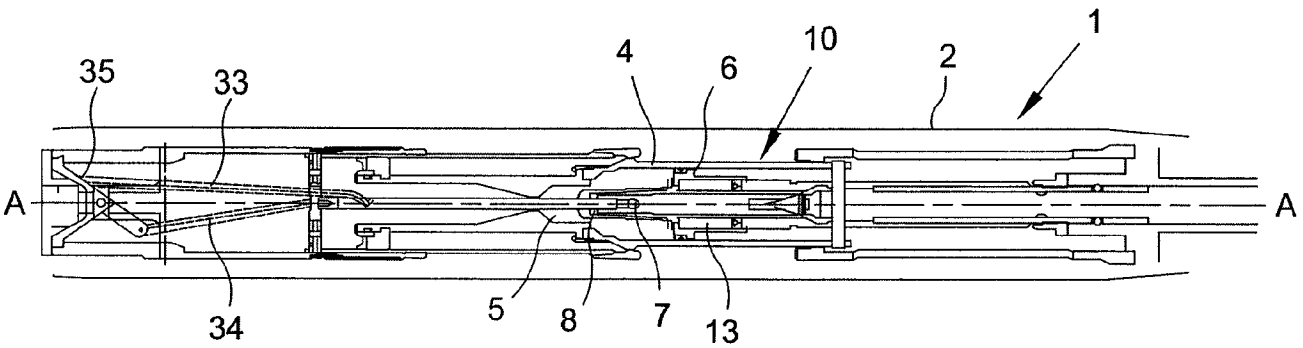
FIGS. 4A and 4B show a current-interrupting chamber of a fourth embodiment of the present invention.

FIG. 4A shows a fourth embodiment of an interrupting chamber 1. Unlike in the preceding embodiments, both of the arcing contacts of the fourth embodiment are moving contacts. As in FIGS. 1A to 1C, the first arcing contact 8 is integrated into the piston 6. Thus, as in the first embodiment, the first arcing contact 8 is mounted to move between the position at the end of compression of the first chamber 5 and the position at the end of the circuit-breaker opening operation.

Figure 4B:
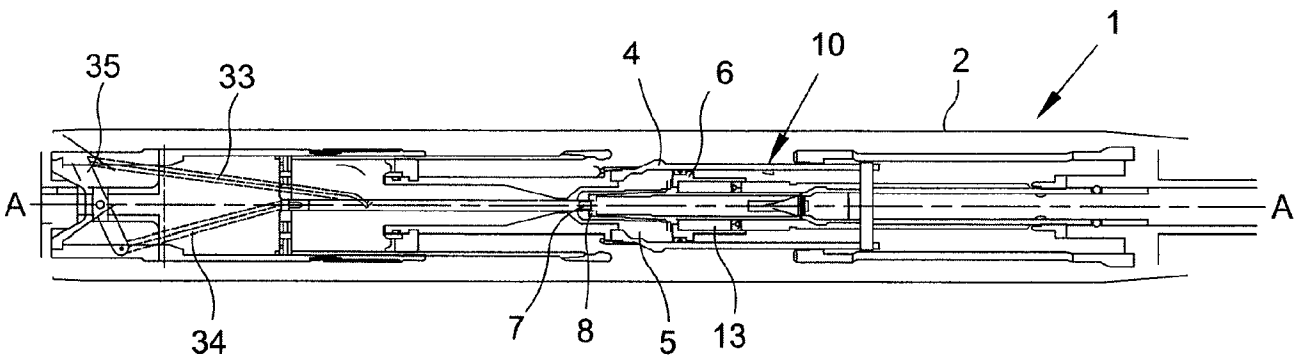

FIG. 4B shows the current-interrupting chamber 1 in the position at the end of compression of the first chamber 5. Between this position and the position shown in FIG. 4A, the piston 6 has remained stationary. The first tubular element 4 has moved axially along the axis AA, generating compression of the dielectric gas that finds itself in the first compression chamber. As can be seen in FIGS. 4A and 4B, the first tubular element 4 moving causes a lever 33 to move, and, via a lever 35, which is connected to the second arcing contact 7 via arms 34, causes the second arcing contact 7 to move axially in the direction opposite to the direction in which the first tubular element moves 4. This dual movement of the contacts makes it possible to reduce the kinetic energy necessary during an opening operation, each contact moving at a speed that is halved compared with the speed required when only one of the two contacts is a moving contact. This use of a lever to enable the two arcing contacts to move in mutually opposite directions is, for example, described in Patent EP 0 313 813.

The present invention is particularly suitable for operating at high voltages, e.g. when the voltage is higher than 245 kV.

Figure 5:
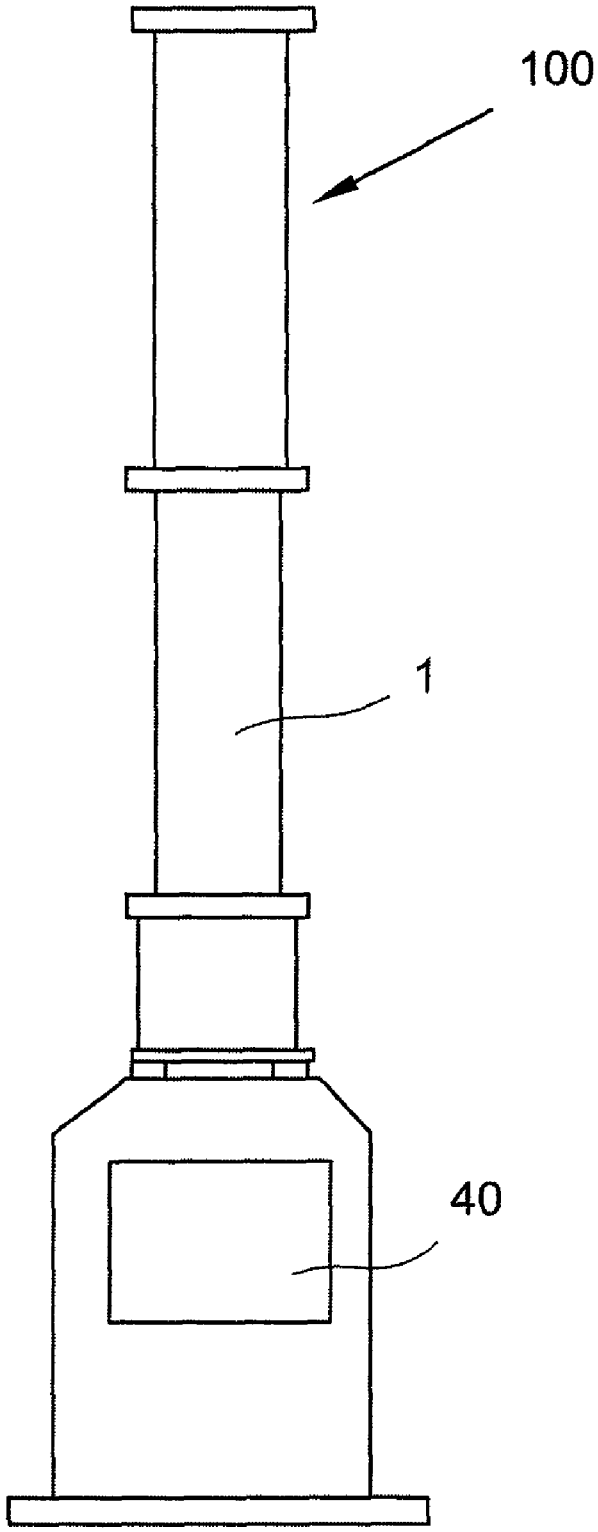
FIG. 5 shows a power circuit-breaker of the present invention, including a current-interrupting chamber of the invention.

The present invention also relates to a circuit-breaker 100, shown in FIG. 5, including any of the above-described embodiments of an interrupting chamber 1. The circuit-breaker 100 is, for example, a high-voltage or medium-voltage power circuit-breaker, i.e. a circuit-breaker used for voltages higher than about 52 kV. The interrupting chamber 1 is connected to a drive member 40 making it possible to actuate compression in the interrupting chamber 1, and opening of the circuit-breaker 100.

Although several embodiments of the present invention are described above in detail, it is to be understood that various changes and modifications can be made without going beyond the ambit of the invention.

The invention claimed is:

1. A current-interrupting chamber for use in a circuit-breaker, said current-interrupting chamber being filled with a dielectric fluid and including:

a moving assembly mounted to move axially between a position at the start of a circuit-breaker opening operation and a position at the end of the circuit-breaker opening operation, said moving assembly comprising:

a) a first compression chamber whose volume decreases between the position at the start of the circuit-breaker opening operation and a position at the end of compression of the first chamber;

b) a first arcing contact that co-operates with a second arcing contact, the first arcing contact and the second arcing contact being mounted to move axially relative to each other, the first arcing contact and the second arcing contact are in contact with each other at the position at the end of compression of the first chamber; and c) a second compression chamber, communicating at a first end with the first compression chamber, the volume of said second compression chamber decreasing between the position at the start of the circuit-breaker opening operation and the position at the end of the circuit-breaker opening operation, said second compression chamber being designed to inject dielectric fluid into the first compression chamber, between a position where the first arcing contact and the second arcing contact are separated and the position at the end of the circuit-breaker opening operation, when the pressure in the first compression chamber is lower than the pressure in the second compression chamber, wherein the position at the end of compression of the first chamber is reached before the position at the end of the circuit-breaker opening operation, and a position at the end of compression of the second chamber is reached after the position at the end of compression of the first chamber.

2. The current-interrupting chamber according to claim 1, wherein the second compression chamber communicates with the first compression chamber via at least one valve.

3. The current-interrupting chamber according to claim 2, wherein at least one valve is a check valve.

4. The current-interrupting chamber according to claim 1, including at least one first tubular element forming the first compression chamber.

5. The current-interrupting chamber according to claim 1, wherein the first compression chamber has, at a first end, a nozzle co-operating with the second arcing contact to channel the dialectic fluid coming from said first compression chamber.

6. The current-interrupting chamber according to claim 1, including at least one piston for closing the first compression chamber at a second end.

7. The current-interrupting chamber according to claim 6, including means for holding the at least one piston stationary between the position at the start of the circuit-breaker opening operation and the position at the end of compression of the first chamber.

8. The current-interrupting chamber according to claim 7, wherein the means for holding the at least one piston stationary comprise at least one recess designed to receive an abutment coupled to the at least one piston.

9. The current-interrupting chamber according to claim 8, wherein the abutment is constituted by a ball.

10. The current-interrupting chamber according to claim 6, including means for moving the at least one piston axially with the moving assembly between the position at the end of compression of the first chamber and the position at the end of the circuit-breaker opening operation.

11. The current-interrupting chamber according to claim 8, including means for releasing the abutment from the recess between the position at the end of compression of the first chamber and the position at the end of the circuit-breaker opening operation.

12. The current-interrupting chamber according to claim 11, wherein the means making it possible to release the abutment comprise at least one recess serving to receive said abutment.

13. The current-interrupting chamber according to claim 1, including at least two coaxial second tubular elements forming the second compression chamber.

14. The current-interrupting chamber according to claim 1, including means for closing the second compression chamber at a second end.

15. The current-interrupting chamber according to claim 14, wherein the means for closing the second compression chamber are stationary.

16. The current-interrupting chamber according to claim 15, wherein the means for closing the second compression chamber comprise at least one sleeve.

17. The current-interrupting chamber according to claim 15, wherein the means for closing the second compression chamber comprise at least one filling valve and at least one discharge valve.

18. The current-interrupting chamber according to claim 14, wherein the means for closing the second compression chamber are moving means.

19. The current-interrupting chamber according to claim 18, wherein the means for closing the second compression chamber comprise at least one piston.

20. The current-interrupting chamber according to claim 19, wherein the piston co-operates with at least one spring.

21. The current-interrupting chamber according to claim 1, including at least one partition subdividing the first compression chamber into at least two volumes, the partition being provided with at least one valve making it possible to put the two volumes into communication with each other.

22. The current-interrupting chamber according to claim 21, the at least one valve being a check valve.

23. The current-interrupting chamber according to claim 1, wherein the dielectric fluid is a dielectric gas.

24. The current-interrupting chamber according to claim 23, wherein the dielectric gas is sulfur hexafluoride ($SF_6$), nitrogen ($N_2$), dry air, carbon dioxide ($CO_2$), or a mixture of gases.

25. The current-interrupting chamber according to claim 1, including means for moving the second arcing contact in a direction opposite from the direction in which the moving assembly moves during the circuit-breaker opening operation.

26. A circuit-breaker comprising a current-interrupting chamber according to claim 1.

* * * * *

UNITED STATES PATENT AND TRADEMARK OFFICE

CERTIFICATE OF CORRECTION

PATENT NO. : 7,964,816 B2
APPLICATION NO. : 12/091982
DATED : June 21, 2011
INVENTOR(S) : Denis Dufournet and Michel Perret It is certified that error appears in the above-identified patent and that said Letters Patent is hereby corrected as shown below:

On the Title page, section (73) Assignee, please delete "Areva T&T SA" and insert therefore --Areva T&D SA--.

In Column 2, line 23 please delete the "," after the word "at" and before the word "the".

Signed and Sealed this
Ninth Day of August, 2011

David J. Kappos

David J. Kappos
*Director of the United States Patent and Trademark Office*